US008122591B2

(12) United States Patent
Shoji et al.

(10) Patent No.: US 8,122,591 B2
(45) Date of Patent: Feb. 28, 2012

(54) MANUFACTURING METHOD FOR A HEATING RESISTOR ELEMENT COMPONENT

(75) Inventors: Noriyoshi Shoji, Chiba (JP); Norimitsu Sanbongi, Chiba (JP); Yoshinori Sato, Chiba (JP); Toshimitsu Morooka, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 473 days.

(21) Appl. No.: 12/386,843

(22) Filed: Apr. 23, 2009

(65) Prior Publication Data

US 2009/0265919 A1 Oct. 29, 2009

(30) Foreign Application Priority Data

Apr. 25, 2008 (JP) ..... 2008-115752

(51) Int. Cl.
*H05B 3/00* (2006.01)

(52) U.S. Cl. ..... 29/611; 29/610.1; 29/890.01; 29/890.1

(58) Field of Classification Search ..... 29/611, 29/428, 610.1, 890.01, 890.1; 347/62, 197, 347/202, 205–208; 438/406, 422, 424, 459
See application file for complete search history.

(56) References Cited

U.S. PATENT DOCUMENTS 5,204,282 A * 4/1993 Tsuruta et al. ..... 438/406
5,940,109 A * 8/1999 Taniguchi et al. ..... 347/205

FOREIGN PATENT DOCUMENTS

JP 2007 83532 4/2007

* cited by examiner

*Primary Examiner* — Thiem Phan
(74) *Attorney, Agent, or Firm* — Adams & Wilks

(57) ABSTRACT

In order to provide a manufacturing method for a heating resistor element component, with which an insulating film (undercoat) can be easily handled, damage caused in the insulating film can be reduced, and a high yield can be ensured, the manufacturing method comprises the steps of: processing, on a surface of a supporting substrate (2), a plurality of concave portions (8) each forming a hollow portion (7) at intervals; processing, on the surface of the supporting substrate (2), a concave part (10) for each region straddling the plurality of concave portions (8) in an arrangement direction of the concave portions (8); placing an insulating film (3) made of sheet glass in each concave part (10); and bonding the insulating film (3) to the supporting substrate (2).

3 Claims, 7 Drawing Sheets

FIG. 6

| σ | L | B | t | JUDGEMENT |
|---|---|---|---|---|
| 330 | 55 | 10 | 0. 05 | ○ |
| 660 | 110 | 10 | 0. 05 | ○ |
| 1320 | 220 | 10 | 0. 05 | × |
| 165 | 55 | 20 | 0. 05 | ○ |
| 330 | 110 | 20 | 0. 05 | ○ |
| 660 | 220 | 20 | 0. 05 | ○ |
| 83 | 55 | 40 | 0. 05 | ○ |
| 165 | 110 | 40 | 0. 05 | ○ |
| 330 | 220 | 40 | 0. 05 | ○ |
| 917 | 55 | 10 | 0. 03 | ○ |
| 1833 | 110 | 10 | 0. 03 | × |
| 3667 | 220 | 10 | 0. 03 | × |
| 458 | 55 | 20 | 0. 03 | ○ |
| 917 | 110 | 20 | 0. 03 | ○ |
| 1833 | 220 | 20 | 0. 03 | × |
| 229 | 55 | 40 | 0. 03 | ○ |
| 458 | 110 | 40 | 0. 03 | ○ |
| 917 | 220 | 40 | 0. 03 | ○ |

MANUFACTURING METHOD FOR A HEATING RESISTOR ELEMENT COMPONENT

BACKGROUND OF THE INVENTION

1. Field of the Invention

The present invention relates to a manufacturing method for a heating resistor element component (thermal head) which is used in a thermal printer typically mounted onto a compact information equipment terminal such as a compact handy terminal, and performs printing on a thermal recording medium through selective driving of a plurality of heating elements based on print data.

2. Description of the Related Art

Recently, thermal printers have been widely used in compact information equipment terminals. The compact information equipment terminals are driven by a battery, which leads to strong demands for electric power saving of the thermal printers. Accordingly, there have been growing demands for thermal heads having high heating efficiency.

As to increasing efficiency of the thermal head, there is known a method of forming a heat insulating layer in a lower layer of a heating resistor (for example, see Patent Document JP 2007-83532 A). Among an amount of heat generated in the heating resistor, an amount of upper-transferred heat which is transferred to a wear-resistant layer formed above the heating resistor becomes larger than an amount of lower-transferred heat which is transferred to an insulating substrate located under the heating resistor, and thus energy efficiency required during the printing can be sufficiently obtained.

In the case where the thermal head as described above is manufactured, one undercoat is placed on one substrate. Accordingly, a size (in particular, length and width) of the under coat is increased, and the thus manufactured thermal head is difficult to be handled, leading to a fear that the undercoat may be damaged during transportation.

In addition, a bonding area between the substrate and the undercoat is increased, which leads to a fear that a spot having an adhesion failure is generated between the undercoat and the substrate, the undercoat peels off from the substrate during manufacturing process, and a yield is reduced.

SUMMARY OF THE INVENTION

The present invention has been made in view of the above-mentioned circumstances, and an object thereof is to provide a manufacturing method for a heating resistor element component, which is capable of facilitating handling of the undercoat, reducing damage of the undercoat, and ensuring a high yield.

In order to solve the aforementioned problems, the present invention employs the following means.

According to the present invention, a manufacturing method for a heating resistor element component includes the steps of: processing, on a surface of a supporting substrate, a plurality of concave portions each forming a hollow portion at intervals; processing, on the surface of the supporting substrate, a concave part for each region straddling the plurality of concave portions in an arrangement direction of the concave portions; placing an insulating film made of sheet glass in each concave part; and bonding the insulating film to the supporting substrate.

According to the manufacturing method for a heating resistor element component of the present invention, a plurality of the insulating films made of sheet glass are placed on one supporting substrate, and a size (in particular, length L (mm) and width B (mm)) of the insulating film becomes smaller compared with a conventional manufacturing method in which only one insulating film is placed on one supporting substrate, whereby the insulating film can be easily handled and damage caused in the insulating film during the manufacturing process can be reduced. Accordingly, manufacturing cost can be reduced.

In addition, compared with the conventional manufacturing method in which the insulating film is formed over the entire surface of the supporting substrate, the bonding area between the supporting substrate and the insulating film can be greatly reduced, and hence a spot having an adhesion failure which occurs between the insulating film and the supporting substrate can be reduced. As a result, the insulating film can be prevented from peeling off from the supporting substrate during the manufacturing process, which ensures a high yield.

In the manufacturing method for a heating resistor element component, it is more preferable that the size of the insulating film be set by performing a three-point bend test through application of a load P of 0.1 (N) to a center portion in a longitudinal direction of the insulating film having the length L (mm), the width B (mm), and a plate thickness t (mm) so that a generated stress $\sigma$ (MPa) obtained by an equation $3PL/2Bt2$ is equal to or smaller than 1,000.

According to the manufacturing method for a heating resistor element component as described above, a strength of the insulating film itself is ensured, and the insulating film itself is resistant to damage (is hard to break), which further facilitates handling of the insulating film. Accordingly, the damage caused in the insulating film during manufacturing process can be further reduced, to thereby reduce a manufacturing cost.

In the heating resistor element component, it is more preferable that a length EL (mm) of the concave part and a width EB (mm) of the concave part be set so that a value obtained by subtracting the length L (mm) of the insulating film from the length EL (mm) of the concave part and a value obtained by subtracting the width B (mm) of the insulating film from the width EB (mm) of the concave part are each 0.1 to 0.4 (mm).

According to the manufacturing method for a heating resistor element component as described above, the insulating film made of sheet glass, which is smaller than the concave part (for example, is slightly smaller), is inserted into each concave part one by one, which eliminates the necessity for accurate alignment and temporary fixation for preventing misalignment between the supporting substrate and the insulating film, which are required in the conventional manufacturing method. Therefore, the manufacturing process can be simplified.

According to the present invention, there are achieved effects that handling of the insulating film can be facilitated, damage of the insulating film can be reduced, and a high yield can be ensured.

BRIEF DESCRIPTION OF THE DRAWINGS

In the accompanying drawings:

FIG. 6 is a table showing test results of the three-point bend test, in which a load P of 0.1 (N) is applied to a center portion in a longitudinal direction of a sheet glass having a certain size (length L (mm), width B (mm), and plate thickness t (mm)), as to whether or not the sheet glass is broken;

DETAILED DESCRIPTION OF THE PREFERRED EMBODIMENT

Hereinafter, with reference to FIG. 1 to FIG. 4, a manufacturing method for a heating resistor element component according to a first embodiment of the present invention is described.

Figure 1:
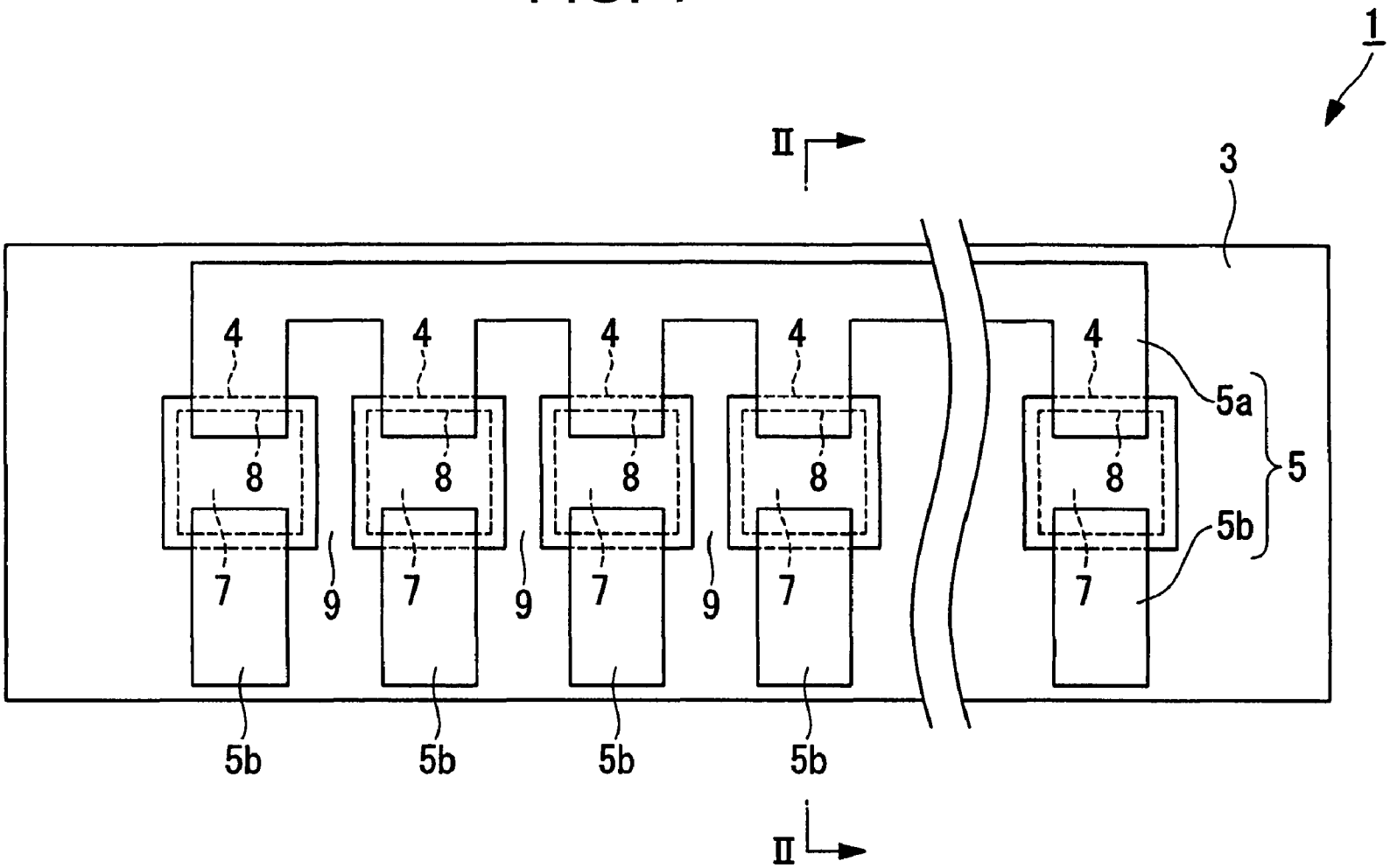
FIG. 1 is a plan view of a heating resistor element component manufactured by a manufacturing method for a heating resistor element component according to a first embodiment of the present invention, which illustrates a state in which a protective film is removed.

FIG. 1 is a plan view of a thermal head which is a heating resistor element component manufactured by the manufacturing method for a heating resistor element component according to this embodiment, which illustrates a state in which a protective film is removed.

Figure 2:
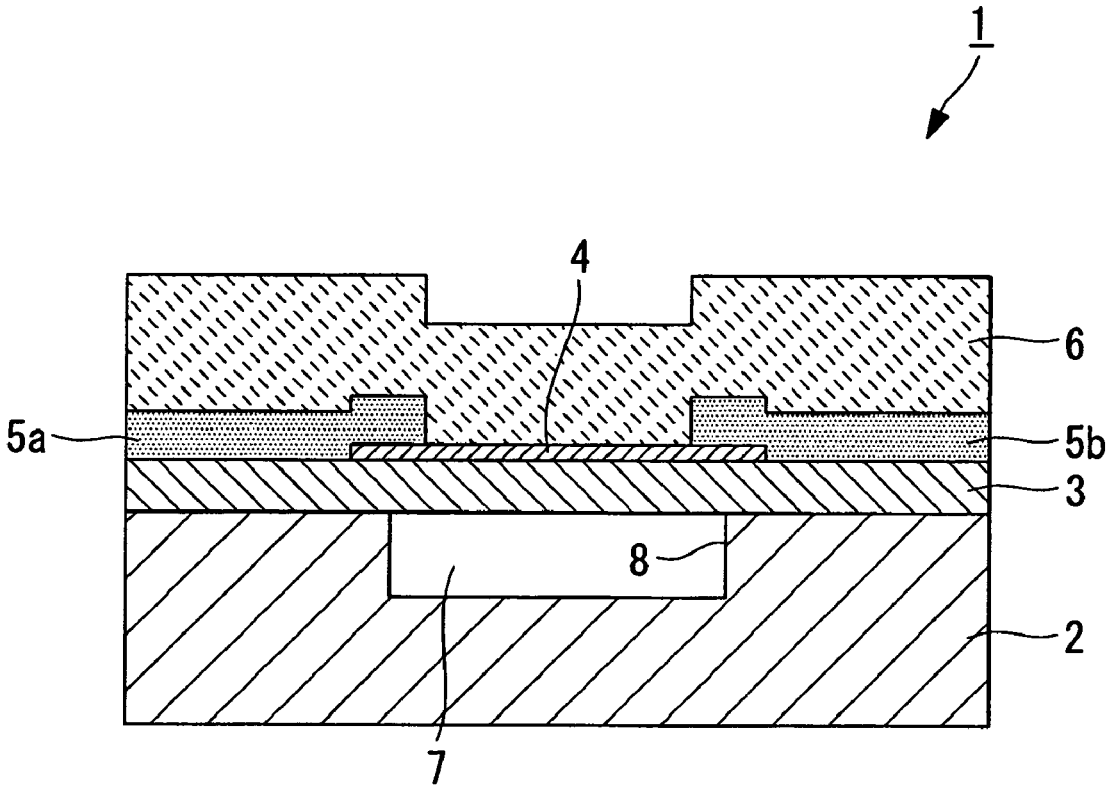
FIG. 2 is a cross-sectional view taken along an arrow II-II of FIG. 1.
Figure 3A:
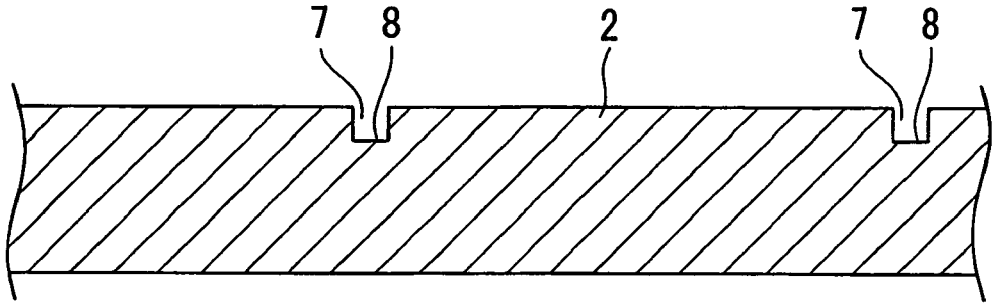
FIGS. 3A-3C are process drawings for describing the manufacturing method for a heating resistor element component according to the first embodiment of the present invention.
Figure 3B:
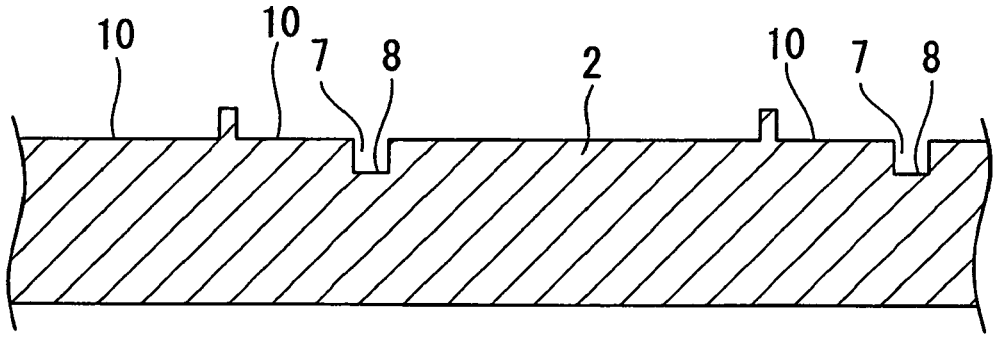
Figure 3C:
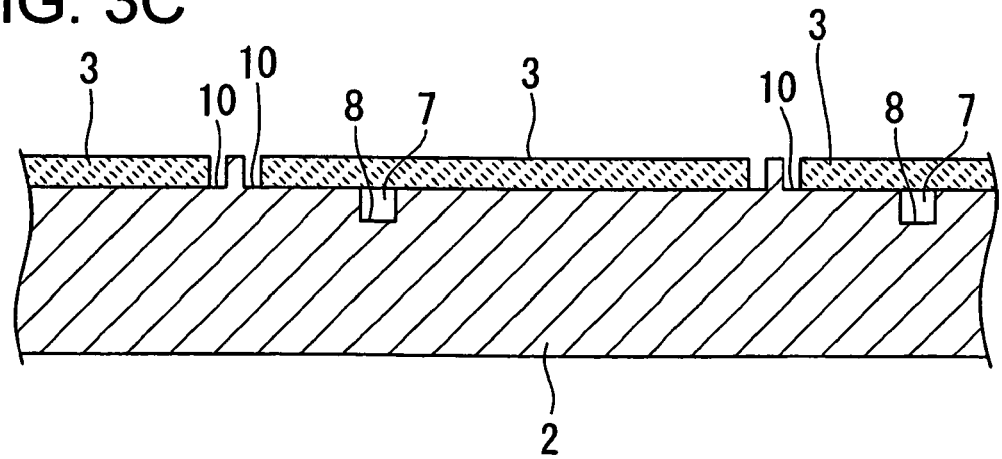
Figure 4:
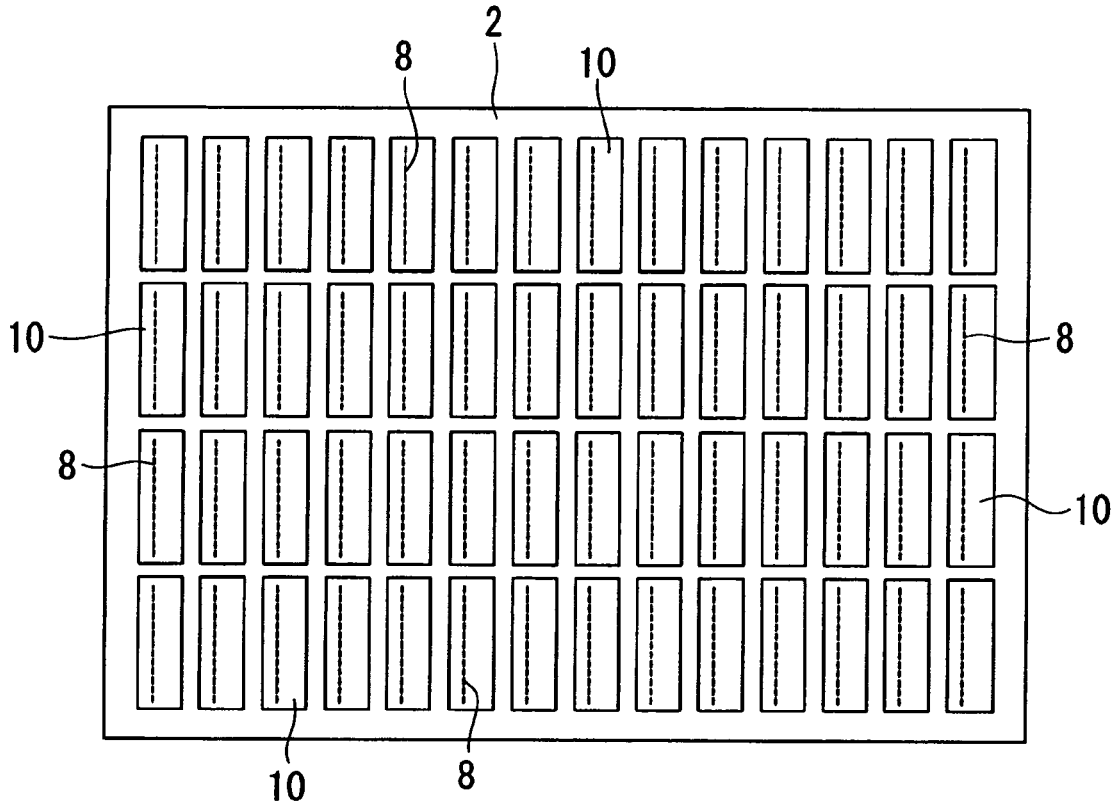
FIG. 4 is a diagram for describing the manufacturing method for a heating resistor element component according to the first embodiment of the present invention, in which a process of FIG. 3B is viewed from above.

FIG. 2 is a cross-sectional view taken along the line II-II of FIG. 1. FIGS. 3A-3C are process drawings for describing the manufacturing method for a heating resistor element component according to this embodiment. FIG. 4 is a diagram for describing the manufacturing method for a heating resistor element component according to this embodiment, in which the process of FIG. 3B is viewed from above.

A heating resistor element component 1 manufactured by the manufacturing method for a heating resistor element component according to this embodiment is a thermal head used in a thermal printer (hereinafter, referred to as "thermal head").

As illustrated in FIG. 2, the thermal head 1 includes a supporting substrate (hereinafter, referred to as "substrate") 2 and an undercoat (insulating film) 3 formed on the substrate 2. In addition, as illustrated in FIG. 1 and FIG. 2, a plurality of heating resistors 4 are formed at intervals in one direction on the undercoat 3, and wiring 5 is connected to the heating resistors 4. The wiring 5 is formed of a common wire 5*a* connected to one end of each of the heating resistors 4 in an object-to-be-printed feeding direction (transport direction: arrangement direction), which is perpendicular to an arrangement direction of the heating resistors 4, and individual wires 5*b* connected to the other end thereof. Further, as illustrated in FIG. 2, the thermal head 1 includes a protective film 6 which covers top surfaces of the heating resistors and a top surface of the wiring 5.

It should be noted that a portion in which the heating resistor actually generates heat (hereinafter, referred to as "heating portion") is a portion which does not overlap the wiring 5.

As illustrated in FIG. 1 and FIG. 2, on a surface (upper surface in FIG. 2) of the substrate 2, there is formed a concave portion which forms a hollow portion (void heat insulating layer) 7.

The concave portion 8 is provided to form the hollow portion (void heat insulating layer) 7 for each heating resistor 4, and adjacent concave portions 8 are separated (partitioned) from each other by an inter-dot barrier 9. A space formed (enclosed) with a bottom surface (surface parallel to the surface of the substrate 2) and wall surfaces (surfaces perpendicular to the surface of the substrate 2) of the concave portion 8 and a rear surface (lower surface in FIG. 2) of the undercoat 3 forms the hollow portion 7.

Through the formation of the plurality of concave portions 8 on the surface of the substrate 2, an entire surface (upper surface in FIG. 2) of the inter-dot barrier 9 located between the adjacent concave portions 8 abuts on the rear surface of the undercoat 3. In other words, the adjacent concave portions 8 are sectioned (partitioned) by the inter-dot barrier 9.

Next, with reference to FIGS. 3A-3C and FIG. 4, a manufacturing method for the thermal head 1 according to this embodiment is described.

First, as illustrated in FIG. 3A, for each region on the surface of the substrate 2 having a uniform thickness, in which the heating resistors 4 are formed, the concave portion 8 which forms the hollow portion 7 is processed. As a material for the substrate 2, for example, a glass substrate or a single-crystal silicon substrate is used. A thickness of the substrate 2 is about 300 μm to 1 mm.

The concave portion 8 is formed on the surface of the substrate 2 by sandblasting, dry etching, wet etching, laser processing, or the like.

In the case where the substrate 2 is processed by sandblasting, the surface of the substrate 2 is covered with a photoresist material, and the photoresist material is exposed to light using a photo mask having a predetermined pattern, thereby solidifying a portion other than a region in which the concave portions 8 are to be formed. Then, the surface of the substrate 2 is washed, and the photoresist material which has not been solidified is removed, thereby obtaining an etching mask having etching windows formed in the region in which the concave portions 8 are to be formed. The surface of the substrate 2 is subjected to sandblasting in this state, and thus the concave portion 8 having a predetermined depth is obtained.

In the case where processing is performed through etching, the etching mask having the etching windows formed in the region in which the concave portions 8 are to be formed is formed on the surface of the substrate 2 in the same manner, and the surface of the substrate 2 is subjected to etching in this state, whereby the concave portion 8 having the predetermined depth is obtained. In the etching process, for example, wet etching is performed using an etching liquid such as a tetramethylammonium hydroxide solution, a KOH solution, a mixed liquid of fluorinated acid and nitric acid, or the like in the case of the single-crystal silicon, and wet etching is performed using a fluorinated acid etching liquid or the like in the case of the glass substrate. In addition, dry etching such as reactive ion etching (RIE) or plasma etching is employed.

Next, the etching mask is all removed from the surface of the substrate 2. Then, as illustrated in FIG. 3B and FIG. 4, for each region straddling the plurality of (13 in this embodiment) concave portions 8, which correspond to one product, a concave part 10 having a rectangular shape in plan view (oblong shape in this embodiment) is processed on the surface of the substrate 2 in the arrangement direction of the concave portions 8 by the method similar to that of the concave portion 8.

Then, the undercoat 3 made of sheet glass, which is smaller (for example, slightly smaller) than the concave part 10, is placed (is inserted) in each concave part 10 one by one. When the undercoats 3 have been put in all the concave parts 10, the undercoats 3 are bonded to the substrate 2.

It should be noted that, in the case where the undercoats 3 made of sheet glass are bonded to the substrate 2 made of glass, bonding is performed by thermal fusion bonding in which a bonding layer is not used. The process of bonding the undercoats 3 made of sheet glass to the substrate 2 made of glass is performed at temperature equal to or higher than annealing points of the substrate 2 made of glass and the undercoats 3 made of sheet glass and equal to or lower than softening points thereof. For this reason, shape accuracy of the substrate 2 and the undercoats 3 can be maintained, which provides high reliability.

The undercoat 3 made of sheet glass is easily broken if a length L (mm) thereof is long (large), if a width B (mm) thereof is narrow (small), or if a plate thickness t (mm) thereof is thin (small).

Figure 5:
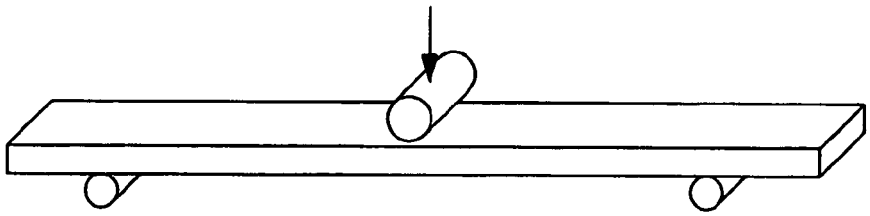
FIG. 5 is a conceptual diagram of a three-point bend test.

Here, by the method as illustrated in FIG. 5, a load P of 0.1 (N) is applied to a center portion in a longitudinal direction of the sheet glass having a certain size (length L (mm), width B (mm), and plate thickness t (mm)), and there is performed a three-point bend test as to whether or not the sheet glass is broken. FIG. 6 is a table showing test results thereof, and in FIG. 6, σ represents a generated stress (Mpa) which is obtained by an equation 3PL/2Bt2, judgement "○" indicates that the sheet glass is not broken, and judgement "x" indicates that the sheet glass is broken. From FIG. 6, it is conceivable that the sheet glass is not broken when a value of σ is equal to or smaller than 1,000, and that the sheet glass is broken when the value exceeds 1,000.

Therefore, as the size of the undercoat 3 placed (inserted) in the concave part 10, a condition of $\sigma \leqq 1{,}000$ (more preferably, condition of $\sigma \leqq 500$) needs to be satisfied.

Figure 7:
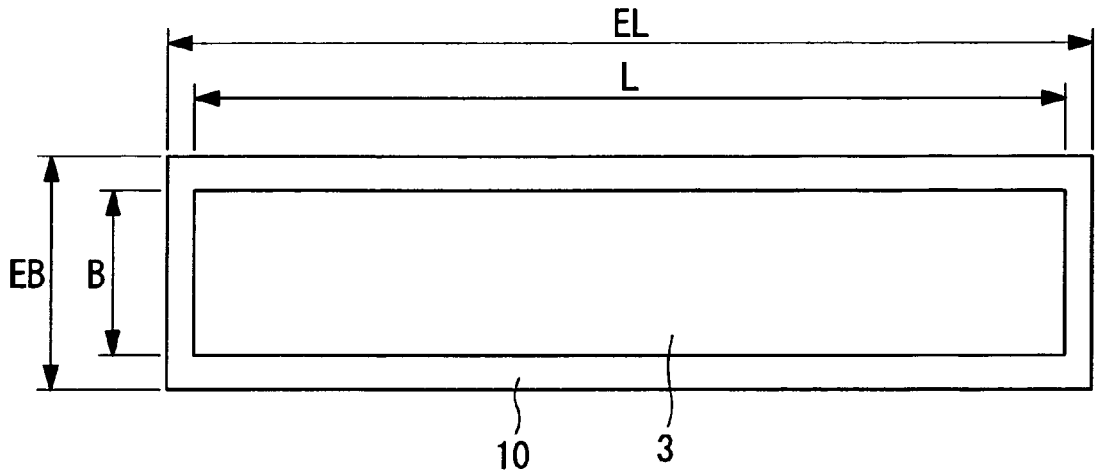
FIG. 7 is a plan view in which a process of FIG. 3C is viewed from above, which is an enlarged view of a pair of a concave portion and an undercoat.

On the other hand, a length EL (mm) and a width EB (mm) of the concave part 10, which are illustrated in FIG. 7, are set to EL−L=0.1 to 0.4 (mm) and EB−B=0.1 to 0.4 (mm), respectively. A depth h (not shown) of the concave part 10 is set to a value which is equal to or a little (slightly) smaller than the plate thickness t of the undercoat 3.

It should be noted that, if EL−L=0.1 (mm) and EB−B=0.1 (mm), the undercoat 3 is completely inserted into the concave part 10 without rattling, and if 0.1 (mm)<EL−L≦0.4 (mm) and 0.1 (mm)<EB−B≦0.4 (mm), manufacturing can be performed without any difficulty while there is a little rattling (gap) therebetween.

Next, the heating resistors 4 (see FIG. 2), the individual wires 5*b* and the common wire 5*a* (see FIG. 2), and the protective film 6 (see FIG. 2) are sequentially formed on the undercoat 3 thus formed. It should be noted that the heating resistors 4, the individual wires 5*b*, and the common wire 5*a* are formed in an appropriate order.

The heating resistors 4, the individual wires 5*b*, the common wire 5*a*, and the protective film 6 can be manufactured using a manufacturing method therefor which is conventionally employed in a thermal head. Specifically, a thin film formation method such as sputtering, chemical vapor deposition (CVD), and vapor deposition is used to form a thin film made of a Ta-based or silicide-based heating resistor material on the insulating film, and the thin film made of the heating resistor material is molded using lift-off, etching, or the like, whereby a heating resistor having a desired shape is formed.

Similarly, on the undercoat 3, a film made of a wiring material such as Al, Al—Si, Au, Ag, Cu, and Pt is prepared using sputtering, vapor deposition, or the like to be formed using lift-off or etching, or the wiring material is screen-printed and is, for example, baked thereafter, to thereby form the individual wires 5*b* and the common wire 5*a* which have the desired shape.

After the formation of the heating resistors 4, the individual wires 5*b*, and the common wire 5*a* as described above, a film made of a protective film material such as $SiO_2$, $Ta_2O_5$, SiAlON, $Si_3N_4$, or diamond-like carbon is formed on the undercoat 3 using sputtering, ion plating, CVD, or the like to form the protective film 6.

According to the manufacturing method for the thermal head 1 of this embodiment, a plurality of undercoats 3 made of sheet glass are placed on one substrate 2, and the size (in particular, length L (mm) and width B (mm)) of the undercoat 3 becomes considerably smaller compared with the conventional manufacturing method in which only one undercoat 3 is placed on one substrate 2, with the result that the undercoat 3 can be handled easily. Accordingly, damage caused in the undercoat 3 during the manufacturing process can be greatly reduced, thereby reducing the manufacturing cost.

Moreover, according to the manufacturing method for the thermal head 1 of this embodiment, the undercoat 3 made of sheet glass, which is smaller (for example, slightly smaller) than the concave part 10, are inserted into the concave part 10 one by one, with the result that accurate alignment and temporary fixation for preventing misalignment between the substrate 2 and the undercoat 3, which are required in the conventional manufacturing method, can be made unnecessary, achieving a simplification of the manufacturing process.

Further, according to the manufacturing method for the thermal head 1 of this embodiment, compared with the conventional manufacturing method in which the undercoat 3 is formed on the entire surface of the substrate 2, the bonding area between the substrate 2 and the undercoat 3 can be considerably reduced, and hence a spot having an adhesion failure which occurs between the undercoat 3 and the substrate 2 can be reduced. As a result, the undercoat 3 can be prevented from peeling off from the substrate 2 during the manufacturing process, ensuring a high yield.

A manufacturing method for a thermal head according to a second embodiment of the present invention is described with reference to FIG. 8.

Figure 8:
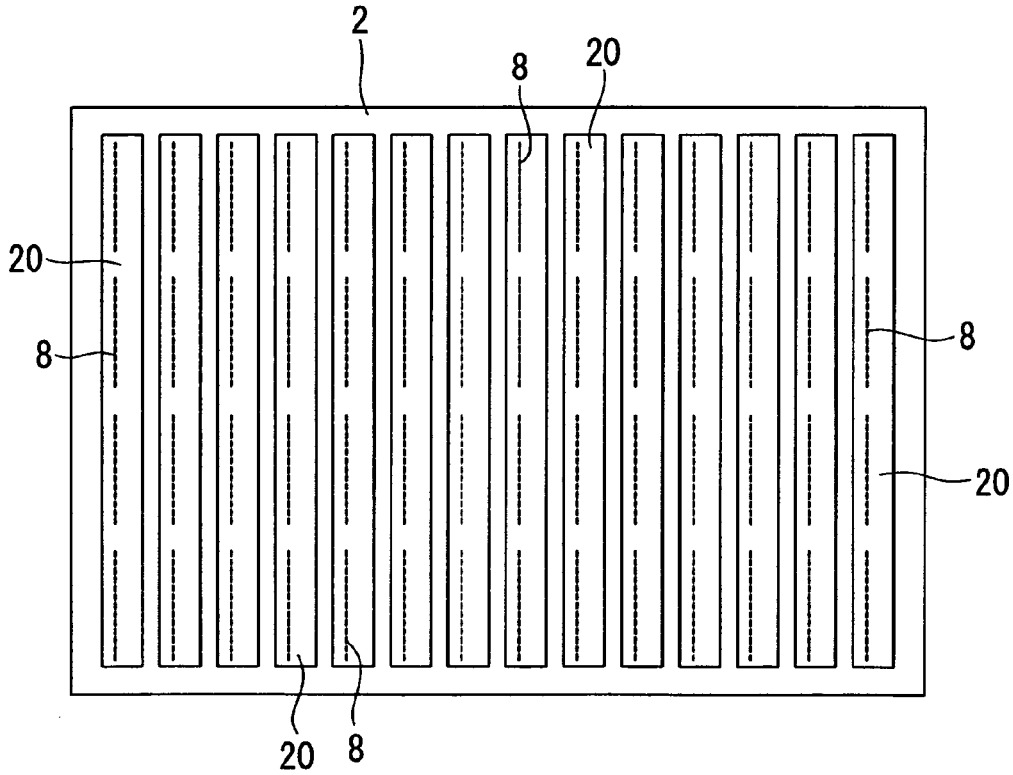
FIG. 8 is a view for describing a manufacturing method for a heating resistor element component according to a second embodiment of the present invention, which is a plan view in which a process corresponding to the process of FIG. 3B is viewed from above.

FIG. 8 is a view for describing the manufacturing method for a thermal head according to this embodiment, which is a plan view in which a process corresponding to the process of FIG. 3B is viewed from above.

As illustrated in FIG. 8, the manufacturing method for a thermal head according to this embodiment is different from the manufacturing method according to the first embodiment described above in that there is provided the step of forming a concave part 20 having a rectangular shape in plan view (oblong shape in this embodiment) on the surface of the substrate 2 in the arrangement direction of the concave portions 8 for each region straddling a plurality of (52 in this embodiment) concave portions 8, which correspond to four products. Other respects are the same as those of the first embodiment described above, and hence their descriptions are omitted here.

According to the manufacturing method for a thermal head of this embodiment, the number of the undercoats 3 made of sheet glass becomes fewer than that of the first embodiment (becomes a quarter of the number of the first embodiment), and hence the number of placing the undercoat 3 on the substrate 2 becomes fewer (becomes a quarter of the number of the first embodiment). Therefore, the manufacturing process can be simplified.

Other operation and effect are the same as those of the first embodiment described above, and hence their descriptions are omitted here.

A manufacturing method for a thermal head according to a third embodiment of the present invention is described with reference to FIG. 9.

Figure 9:
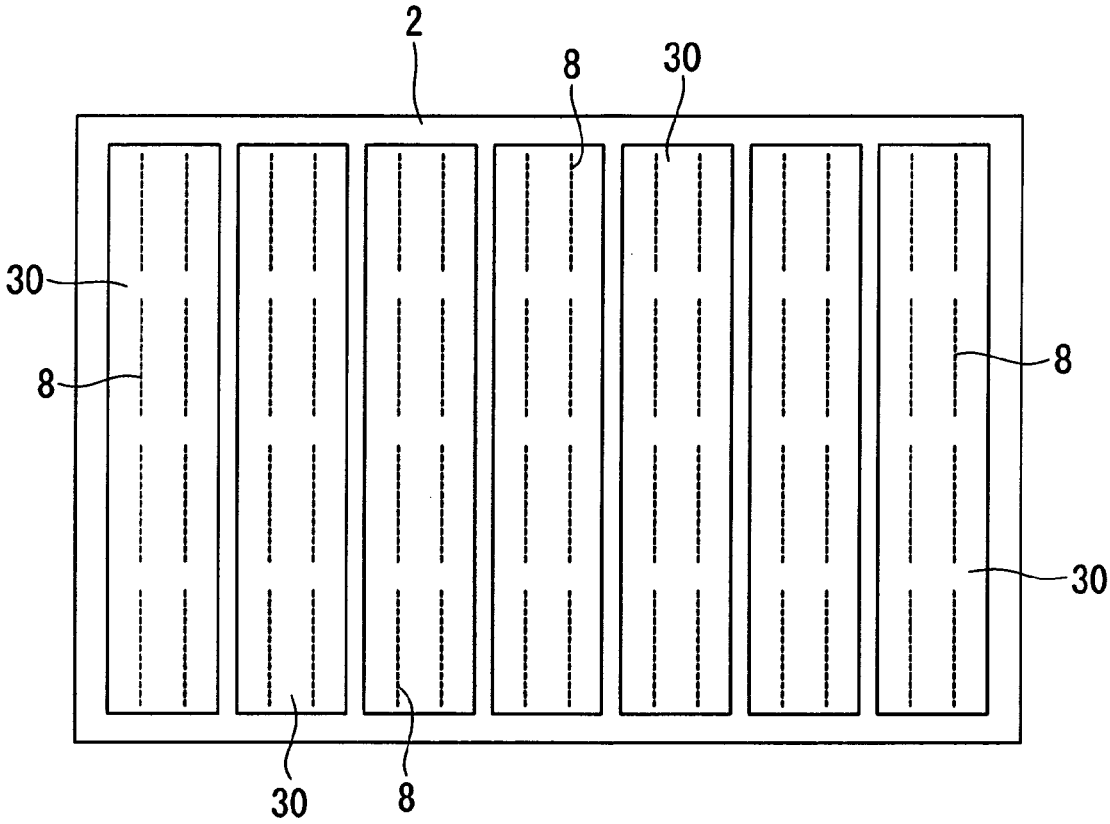
FIG. 9 is a view for describing a manufacturing method for a heating resistor element component according to a third embodiment of the present invention, which is a plan view in which the process corresponding to the process of FIG. 3B is viewed from above.

FIG. 9 is a view for describing the manufacturing method for a thermal head according to this embodiment, which is a plan view in which a process corresponding to the process of FIG. 3B is viewed from above.

As illustrated in FIG. 9, the manufacturing method for a thermal head according to this embodiment is different from the manufacturing method according to the first embodiment described above in that there is provided the step of forming a concave part 30 having a rectangular shape in plan view (oblong shape in this embodiment) on the surface of the substrate 2 in the arrangement direction and a transport direction (direction orthogonal to the arrangement direction) of the concave portions 8 for each region straddling a plurality of (104 in this embodiment) concave portions 8, which correspond to eight products. Other respects are the same as those of the first embodiment described above, and hence their descriptions are omitted here.

According to the manufacturing method for a thermal head of this embodiment, the number of the undercoats 3 made of sheet glass becomes fewer than that of the first embodiment (becomes one eighth of the number of the first embodiment), and hence the number of placing the undercoat 3 on the substrate 2 becomes fewer (becomes one eighth of the number of the first embodiment). Therefore, the manufacturing process can be simplified.

Other operation and effect are the same as those of the first embodiment described above, and hence their descriptions are omitted here.

The manufacturing method for a thermal head according to the present invention is not limited to those of the embodiments described above, and they can be modified, changed, and combined as appropriate according to the necessity.

For example, in the embodiments described above, the descriptions are made of the case where the concave portions 8 are formed on the surface of the substrate 2, and then, the concave parts 10, 20, or 30 are formed. However, the concave portions 8 may be formed after the formation of the concave parts 10, 20, or 30.

What is claimed is:

1. A manufacturing method for a heating resistor element component, comprising the steps of:

processing, on a surface of a supporting substrate, a plurality of concave portions each forming a hollow portion at intervals;

processing, on the surface of the supporting substrate, a concave part for each region straddling the plurality of concave portions in an arrangement direction of the concave portions;

placing an insulating film made of sheet glass in each concave part; and bonding the insulating film to the supporting substrate.

2. The manufacturing method for a heating resistor element component according to claim 1, wherein a size of the insulating film is set by performing a three-point bend test through application of a load P of 0.1 (N) to a center portion in a longitudinal direction of the insulating film having a length L (mm), a width B (mm), and a plate thickness t (mm) so that a generated stress σ (MPa) obtained by an equation 3PL/2Bt2 is equal to or smaller than 1,000.

3. The manufacturing method for a heating resistor element component according to claim 2, wherein a length EL (mm) of the concave part and a width EB (mm) of the concave part are set so that a value obtained by subtracting the length L (mm) of the insulating film from the length EL (mm) of the concave part and a value obtained by subtracting the width B (mm) of the insulating film from the width EB (mm) of the concave part are each 0.1 to (mm).

* * * * *